US005678342A

United States Patent [19]

Felk

[11] Patent Number: 5,678,342

[45] Date of Patent: Oct. 21, 1997

[54] AUTOMATIC PISTON FIRING MECHANISM

[76] Inventor: Edward Karl Felk, 126 Skye Pt. Rd., Coal Point, NSW 2283, Australia

[21] Appl. No.: 501,582

[22] Filed: Jul. 12, 1995

[51] Int. Cl.[6] ..... F41A 17/54; F41A 19/35

[52] U.S. Cl. ..... 42/69.02; 89/196; 42/70.07

[58] Field of Search ..... 42/69.02, 70.06, 42/70.07; 89/195, 196, 163

[56] References Cited

U.S. PATENT DOCUMENTS

| | | | |
|---|---|---|---|
| 920,682 | 5/1909 | Stephan | 42/70.06 |
| 1,430,662 | 10/1922 | Lewis | 42/70.06 |
| 2,635,380 | 4/1953 | Bakev et al. | 42/70.06 |
| 3,696,706 | 10/1972 | Seidel et al. | 89/196 |
| 5,355,768 | 10/1994 | Felk | 89/147 |

FOREIGN PATENT DOCUMENTS

| | | | |
|---|---|---|---|
| 371665 | 3/1923 | Germany | 89/195 |

*Primary Examiner*—Stephen M. Johnson

[57] ABSTRACT

An automatic pistol including a trigger safety which is pivotally mounted through the trigger guard to prevent the rearward movement of the trigger; a trigger bar with a ledge to engage a firing pin foot to move it in a rearward direction and an inclined edge in the ejector plate for engagement of the trigger bar wing for disengagement of the ledge in the trigger bar off the firing pin foot; a firing pin embodying a stepped chamber and containing within a spring mechanism for propelling the firing pin into the cartridge chamber.

5 Claims, 1 Drawing Sheet

AUTOMATIC PISTON FIRING MECHANISM

FIELD OF THE INVENTION

This invention relates to automatic pistols of the type which automatically eject the spent cartridge and chamber a new one after each shot.

BACKGROUND OF THE INVENTION

It is known that automatic pistols usually require many parts to manufacture them and make them function safely. They are usually complicated to handle and prone to accidental discharges if jarred when the pistol is loaded and cocked in ready to fire condition, thus requiring an external safety to prevent the pistol from discharging accidentally. The above makes the pistol hard to handle and costly to manufacture.

OBJECT OF THIS INVENTION

It is therefore the object of this invention to provide an improved pistol which is easy to use, requires a small number of parts to make it function, is safe to handle, can be produced at a very low cost.

SUMMARY OF THE INVENTION

This object is attained with this invention of a pistol which comprises a frame with a magazine receiving rear, a floating barrel with a cartridge receiving rear, and a slide with a breech-block in the rear which slides on the frame and engages over the barrel to form a cartridge chamber. A trigger safety lever pivotally connected in a slot through the trigger guard for prevention of the trigger to be moved rearward into the activating position if the trigger happens to be hooked up on clothes or the like when handling the pistol. The firing pin is movable in the breech-block with a strong spring assembly in the rear cavity of same to propel said firing pin from the cocked position into the cartridge chamber to fire the cartridge. A relatively weak spring is loaded on the front of the firing pin to urge same backwards in order to stop the firing pin entering the cartridge chamber when the pistol is dropped and to return it back into the breech-block after a shot has been fired. It is not strong enough to stop the firing pin entering the chamber when propelled by the strong propelling spring.

The trigger pivots in the frame and moves between the inactivated and activated positions. The trigger bar is connected to the trigger and has a ledge to engage the firing pin foot as it moves into the ready position for displacement of the firing pin backward into the rear position by moving the trigger to the activated position. In the rear position the ledge disengages from the firing pin foot which allows the firing pin to be propelled forward into the cartridge chamber to fire the shot and then return into the ready position on release of the trigger to the forward position.

According to this invention the ready position for the firing mechanism is such that there is no compression of the propelling spring, therefore it is impossible for the pistol to discharge if the pistol is dropped. In other words, the ready position of the pistol is the uncocked condition. The cocking of the pistol for each shot is effected by the movement of the trigger to the activated position thus the condition of the pistol is the same for all shots. In this invention the ejector plate embodies an inclined edge to co-act with the trigger bar's wing to pull the ledge of the trigger bar down to disengage said ledge off the firing pin foot.

According to this invention handling of the pistol is very simple. The pistol is read for firing after chambering a cartridge and is completely safe. Similarly because of the uncocked condition of the pistol, it is drop and jar-proof. With this invention a very small number of parts are required to produce the pistol. The frame is manufactured in one piece out of synthetic resin and the slide, barrel, firing pin and some of the minor parts out of steel. Therefore, manufacturing of the pistol is inexpensive and simple. Because of the pistol's simplicity and light weight it is very easy to use compared with pistols made entirely from metallic parts.

SPECIFIC DESCRIPTION

Figure 1:
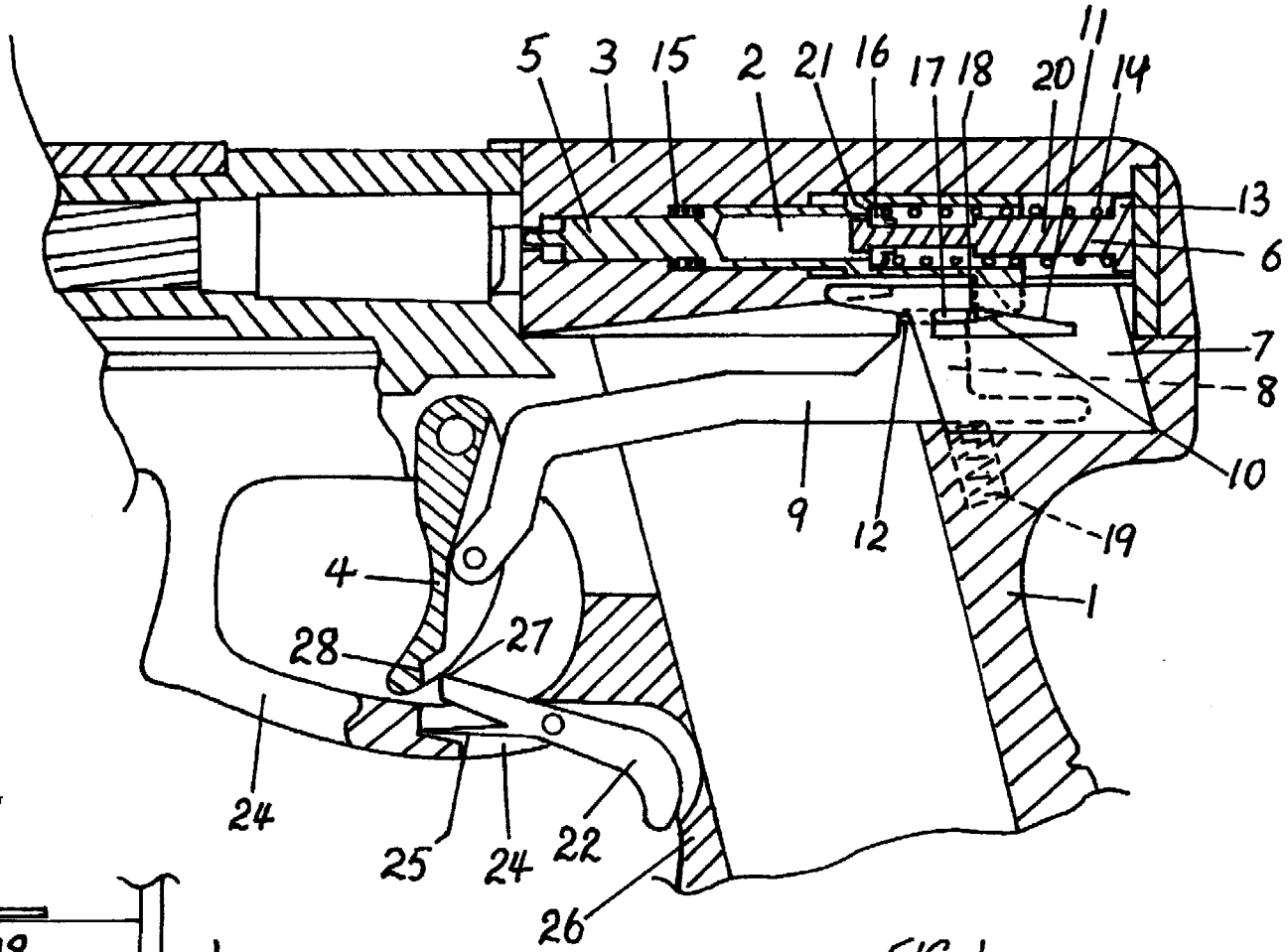
FIG. 1 is a longitudinal section through the firing mechanism.
Figure 2:
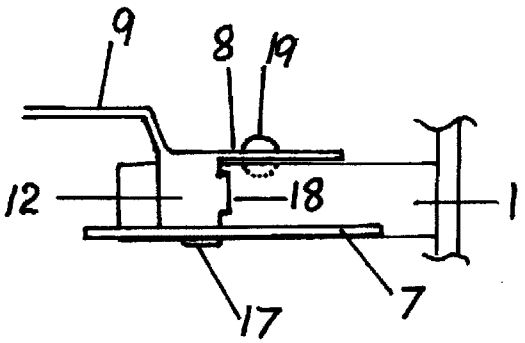
FIG. 2 is a top view of the rear section of the trigger bar and ejector plate assembly.

FIGS. 1 and 2 show the firing mechanism of this invention wherein a trigger safety lever (22) pivotally mounted in a slot (23) in the trigger guard (24), embodied in said lever (22) is a projection (25) acting as a return spring, the position of the projection is not of importance and a spring can be used in its place, said lever (22) when at rest protrudes from the bottom of the trigger guard (24) and the front of the grip (26) and the tip (27) of said lever is in operative engagement with a ledge (28) of the trigger (4), therefore effectively preventing the trigger (4) from being moved to the activating position. When pressure is upplied to the lever (22) by a hand embracing the grip (26) the lever (22) retracts into the trigger guard (24), automatically disengaging the tip (27) from operative engagement with the ledge (28) of the trigger (4) therefore allowing same to be moved backward into activating position.

The trigger bar (9) is pivotally connected to the trigger (4). On the rear of the trigger bar (9) is a web (12) with a wing (17) projecting sideways to pull down the ledge (18) which projects backwards from the web (12) to engage with the firing pin foot (10). The ejector plate (7) embodying an inclined edge (11) co-acts with the wing (17) of the trigger bar (9) for pulling down the ledge (18) out of operative engagement with the foot (10).

The firing pin (5) has a foot (10) to engage with the ledge (18) and a stepped internal chamber (2) to hold a spring mechanism (6) therein. The spring mechanism is of the type wherein the spring (14) is braced on a stepped shaft (20) and held braced thereon by two-piece retaining washer (16) against a flange (13) at the rear of the shaft (20) and the washer (16) slidable on the shaft (20) when the spring (14) is being compressed. The stepped chamber (2) at the rear of the firing pin (5), is designed to hold the spring mechanism (6) within, in a way that the washer (16) is in loose contact with the ledge (21) of the chamber (2), and the firing pin (5) has no load on it when at rest.

A spring (15) placed on the front of the firing pin (5) holds said pin (5) out of the cartridge chamber while at rest, prevents the pin (5) from entering said chamber if the pistol is dropped or the like and return it into cartridge chamber after the pistol has been fired.

When the trigger (4) is being pulled back the trigger bar ledge (18), the firing pin foot (10) operatively engaged with said ledge (18) and the firing pin (5) are being moved backwards, in turn compressing the spring (14) inside the larger portion of the chamber (2). The spring (14) is compressed as the ledge (21) inside the chamber (2) connects the washer (16) pushing same back while allowing the shaft (20)

to pass between washer (16) and into the smaller portion of the chamber (2) of the firing pin (5). At the same time the wing (17) of the trigger bar (9) has contacted the inclined edge (11) in the ejector plate (7) and is pulling down the ledge (18) out of operative engagement with the foot (10) to allow the firing pin (5) to be propelled into the cartridge chamber to fire a shot. While the slide (3) is cycling, the ledge (18) is being held down by the wing (17) against the inclined edge (11) to allow the foot (10) to pass over te ledge (18). In the meantime the slide (3) has chambered a cartridge and locked against the barrel ready for the trigger (4) to be released. As the trigger (4) is moving forward the ledge (18) passes under the foot (10) and as said ledge (18) reaches a point where it is in front of the foot (10) said ledge (18) is lifted up into operative engagement with the foot (10) into the ready position, urged by a spring (19) placed under the trigger bar plate (8) for that purpose. In this condition the pistol is in the ready condition and uncocked.

This invention is not limited to the advantages described above. The simplicity of production of the pistol components is a major advantage.

According to this invention the pistol can be produced at a very low initial tooling up and production cost per unit.

According to this invention the one piece plastic frame (1), including all holes, cavities and slots, can be produced in one operation. There are also advantages in the assembly of the pistol, because of the low number of parts. The pistol can be assembled from components in just a few minutes at the production level.

I claim:

1. An automatic pistol comprising: a frame with a magazine receiving grip; a slide including a breech-block at the rear;

a floating barrel and the slide, movable on the frame with the breech-block engageable over the barrel to form a cartridge chamber;

a firing pin, with a foot at the rear projecting down said firing pin embodying within a stepped chamber with a ledge and containing within said stepped chamber a spring mechanism, including a spring, a two-piece retaining washer and a shaft on which to retain said spring, said firing pin movable in the breech-block, away from and towards the barrel, between its rearmost position when it is out of the cartridge chamber and at the maximum extent of its travel to the rear of the breech-block, and its foremost position when it projects into the cartridge chamber, and including a rest position when it is fully contained within the breech-block between its rearmost and foremost positions;

a trigger and a trigger bar pivotally connected, said trigger bar embodying, at its rearmost end, a plate and a web extending sideways from the plate, said web embodying a wing extending further sideways from the web and with a ledge extending rearward from the web, the trigger and the trigger bar being moveable between their foremost and rearmost positions, in the same directions as the firing pin;

a trigger safety lever embodying a tip and a projection to act as a spring, said lever pivotally mounted in a slot through the trigger guard for preventing the rearward movement of the trigger when the safety lever is at rest and to automatically disengage the tip from operative engagement with a ledge embodied in the trigger when pressure is applied to the lever by a hand embracing the grip;

an ejector plate for ejecting a cartridge, embodying an inclined edge to guide the ledge of the trigger bar as it moves between its foremost and rearmost position;

a triggering mechanism including the trigger and the trigger bar, said trigger bar and the ledge having abutment means, are guided along their path by the inclined edge and wing, said path being a downward one towards the rear of the pistol characterised by the firing pin starting in its rest position with the ledge being positioned in front of the firing pin foot, prior to the actuation of the trigger and the ledge being arranged to engage said foot to carry the firing pin in a rearward direction during the movement of the ledge along its path during activation of the trigger and to disengage from the foot, to release the firing pin to fire a cartridge at the end of its movement when the trigger is in its rearmost position.

2. The pistol defined in claim 1 wherein the projection in the safety lever is braced against the frame acts as a return spring to return said lever into the rest position and the tip of same into operative engagement with the ledge of the trigger.

3. The pistol defined in claim 2 wherein when said hand is embracing the grip the lever retracts into the slot in the trigger guard and automatically disengages the tip of the lever out of operative engagement with the ledge of the trigger.

4. The pistol defined in claim 1 wherein the firing pin has said foot projecting downward in the breech-block and said spring mechanism loaded in the stepped chamber at the rear of said firing pin for propelling same into the cartridge chamber and a weak spring loaded on the front of said firing pin to return same back to its rest position in the breech-block after firing a cartridge.

5. The pistol defined in claim 4 wherein the spring in the spring mechanism is braced against a flange at the rear of the shaft and the two-piece retaining washer at the front of said shaft, therefore when fitted in the stepped chamber of the firing pin the spring mechanism is loose in said stepped chamber, compression of the spring in the spring mechanism only starting with the rearward movement of the firing pin when the ledge in the stepped chamber of said firing pin contacts the two-piece washer compressing the spring while the shaft of the spring mechanism slides past in the washer into the smaller part of the stepped chamber as the rear end of said shaft is braced against the back of the breech block.

* * * * *